US005455596A

United States Patent [19]

Higashiguchi et al.

[11] Patent Number: 5,455,596

[45] Date of Patent: Oct. 3, 1995

[54] ANTENNA MODULE FOR INCORPORATION IN WIRELESS TERMINAL EQUIPMENT SUCH AS PORTABLE TELEPHONE

[75] Inventors: Yutaka Higashiguchi; Mitsuo Inagaki, both of Kawasaki; Hajime Mochizuki, Tokyo; Noriyuki Kohma, Tokyo; Yoshikazu Kamei, Tokyo; Toshiaki Amano, Tokyo, all of Japan

[73] Assignees: Fujitsu Limited, Kanagawa; Furukawa Electric Co., Ltd., Tokyo, both of Japan

[21] Appl. No.: 165,119

[22] Filed: Dec. 10, 1993

[30] Foreign Application Priority Data

Dec. 11, 1992 [JP] Japan ..... 4-331552

[51] Int. Cl.[6] ..... H01Q 1/24

[52] U.S. Cl. ..... 343/741; 343/702; 343/700 MS

[58] Field of Search ..... 343/741, 702, 343/700 MS, 846, 873, 728, 742, 745, 748, 829, 831; 264/261; H01Q 1/38, 1/24

[56] References Cited

U.S. PATENT DOCUMENTS 3,780,373 12/1973 Holst et al. ..... 343/846

5,268,702 12/1993 Amano et al. ..... 343/700 MS

FOREIGN PATENT DOCUMENTS 4185003 7/1992 Japan .

4330806 11/1992 Japan .

5-275915 10/1993 Japan ..... H01Q 1/38

*Primary Examiner*—Donald Hajec

*Assistant Examiner*—Hoanganh Le

[57] ABSTRACT

An antenna module suitable for a reduction in size and weight of equipment and improved in manufacturability. The antenna module includes a ground element formed from a planar conductor, an antenna element formed from a planar conductor and arranged in parallel to the ground element, and a loop element formed from a tubular conductor and arranged between the ground element and the antenna element in predetermined positional relationship with both elements so as to be connected with the antenna element. The loop element has a first hollow portion passing therethrough in a given direction. The antenna module further includes an element support formed from an insulator and arranged so as to fill a space between the ground element and the antenna element and substantially fully cover an outer surface of the loop element. The element support is formed with a second hollow portion passing therethrough in the same direction as that of the first hollow portion of the loop element.

21 Claims, 6 Drawing Sheets

ANTENNA MODULE FOR INCORPORATION IN WIRELESS TERMINAL EQUIPMENT SUCH AS PORTABLE TELEPHONE

BACKGROUND OF THE INVENTION

Field of the Invention

The present invention relates to an antenna module to be incorporated in wireless terminal equipment such as a portable telephone.

Description of the Related Art

In recent years, wireless terminal equipment such as a portable telephone has widely been put to practical use with an increase in communication demand. An antenna module is usually incorporated in a housing of the wireless terminal equipment, so as to ensure a receiving function in carrying the equipment. The antenna module is required to essentially have required electrical characteristics concerning a resonance frequency, a band width, a gain, etc. and additionally have a feature that the module is fit for a reduction in size and weight of the equipment and is excellent in manufacturability.

As such a conventional antenna module to be incorporated in a portable telephone, there are known a platelike inverted F-shaped antenna 2 as shown in FIG. 1 and an S-shaped antenna 4 as shown in FIG. 2. These antenna modules are formed by a sheeting technique, so that they are not necessarily fit for a reduction in size of the equipment. Further, to ensure required electrical characteristics, a high accuracy is required not only for an external size of each element but also for a gap size between an antenna element and a ground element, thus necessitating a high working technique.

FIG. 3 shows another conventional antenna module fit for a reduction in size and weight, which is now in practical use. This antenna module is integrally constructed of a resin molding and a metal conductor foil. As shown in FIG. 3, the antenna module is provided with a ground element 6 and an antenna element 8 each formed from a metal conductor foil, and with an element support 10 formed from an insulator. The element support 10 is interposed between the ground element 6 and the antenna element 8. This antenna module has a height of 10 mm, a width of 15 mm, and a length of 40 mm.

The element support 10 is formed with a hollow portion 10A extending in the longitudinal direction for the purposes of reducing a weight and obtaining a required permittivity of the element support 10. Reference numeral 12 denotes a loop element electrically connected to the antenna element 8. In the condition just after integral molding as shown, an end portion 12A of the loop element 12 remains a free end in relation to a mold drawing direction for the hollow portion 10A of the element support 10. Accordingly, to complete the antenna module, the end portion 12A of the loop element 12 in this condition must be fixed manually by soldering or the like to the antenna element 8, causing a deterioration in workability.

SUMMARY OF THE INVENTION

It is therefore an object of the present invention to provide an antenna module which has required electrical characteristics and is suitable for a reduction in size and weight of equipment.

It is another object of the present invention to provide a manufacturing method for an antenna module which is improved in workability.

In accordance with an aspect of the present invention, there is provided an antenna module comprising a ground element formed from a planar conductor; an antenna element formed from a planar conductor, said antenna element being arranged in substantially parallel relationship to said ground element; a loop element formed from a tubular conductor, said loop element being arranged between said ground element and said antenna element in predetermined positional relationship with both said ground and antenna elements and connected with said antenna element, said loop element having a first hollow portion passing therethrough in a given direction; and an element support formed from an insulator, said element support being arranged so as to fill a space between said ground element and said antenna element and substantially fully cover an outer surface of said loop element, said element support having a second hollow portion passing therethrough in the same direction as that of said first hollow portion of said loop element.

According to the antenna module of the present invention, the direction of pass of the second hollow portion of the element support is identical with the direction of pass of the first hollow portion of the loop element. In other words, a mold drawing direction for the first hollow portion can be made identical with that for the second hollow portion. As a result, a soldering work for completing a loop element after integral molding as required in the prior art is unnecessary, thereby improving the workability.

Furthermore, the antenna module of the present invention has a special design composed of the ground element, the antenna element, the loop element and the element support, so that it is suitable for a reduction in size and weight of equipment.

In accordance with another aspect of the present invention, there is provided a manufacturing method for an antenna module, comprising the steps of bending a flexible printed wiring board into a predetermined shape, said flexible printed wiring board comprising a resin film and a conductor pattern formed on said resin film, said conductor pattern including a ground element pattern, an antenna element pattern and a loop element pattern, thereby forming a loop element from said loop element pattern, said loop element having a first hollow portion passing therethrough in a given direction; setting said flexible printed wiring board bent into said predetermined shape in a mold so that said conductor pattern is positioned in close proximity to an inner surface of said mold; and injecting a curing fluid into said mold so that said curing fluid comes into contact with said resin film, and curing said curing fluid in said mold to thereby form an element support having a second hollow portion passing therethrough in the same direction as that of said first hollow portion of said loop element.

According to the manufacturing method for the antenna module of the present invention, the flexible printed wiring board having the conductor pattern including the ground element pattern, the antenna element pattern and the loop element pattern is used, so that each element can be formed by the single flexible printed wiring board, thereby greatly improving the workability.

Furthermore, since the direction of pass of the first hollow portion is identical with the direction of pass of the second hollow portion, the antenna module of the present invention is suitable especially for integral molding of the element support with a printed wiring board.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

Figure 1:
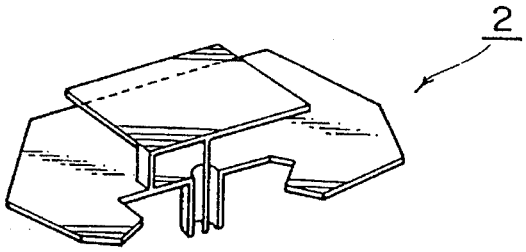
FIG. 1 PRIOR ART
FIG. 1 is a schematic perspective view of an inverted F-shaped antenna in the prior art.
Figure 2:
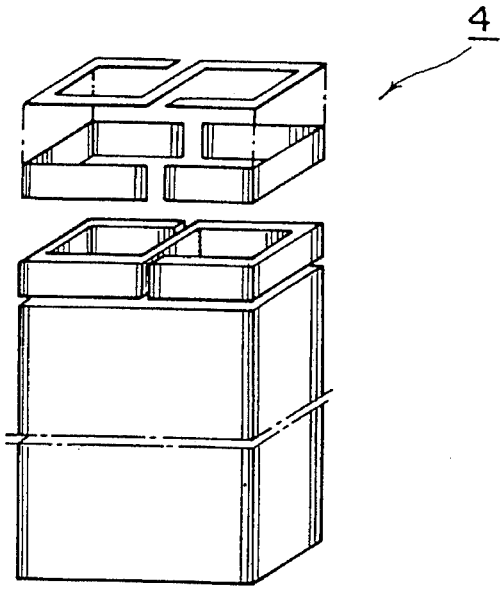
FIG. 2 PRIOR ART
FIG. 2 is a schematic perspective view of an S-shaped antenna in the prior art.
Figure 3:
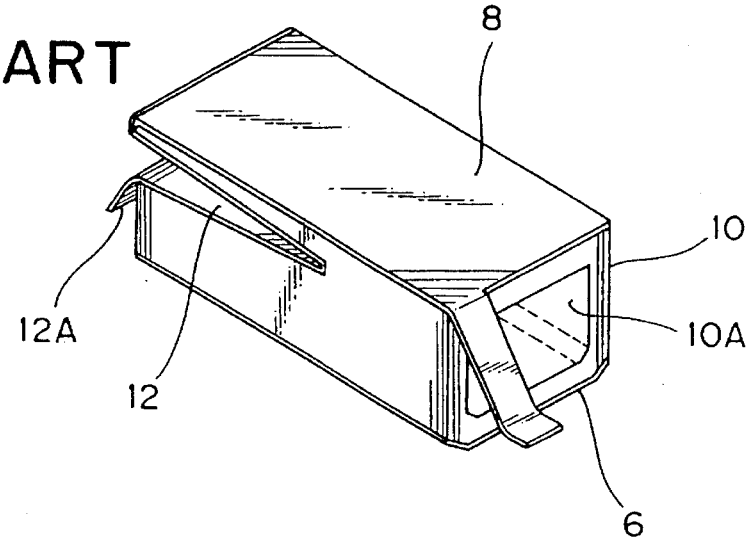
FIG. 3 PRIOR ART
FIG. 3 is a schematic perspective view of a conventional antenna module constructed of a resin molding and a metal conductor foil.
Figure 4:
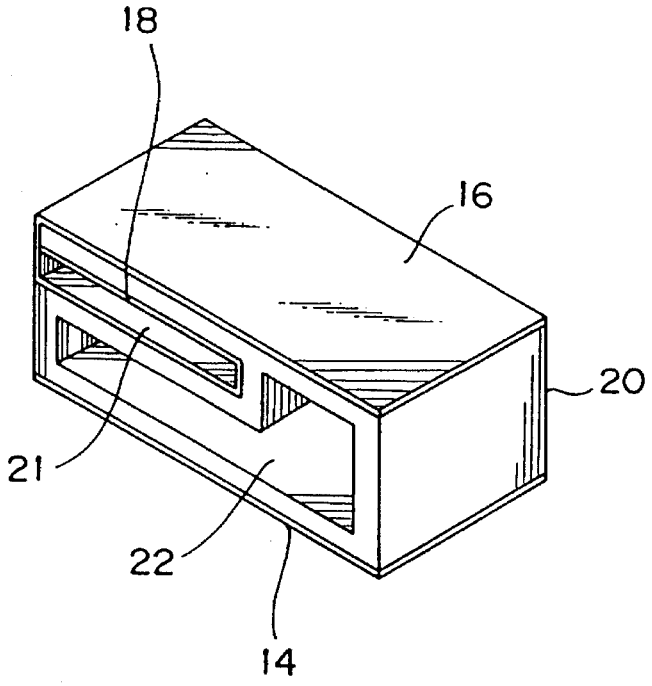
FIG. 4 is a perspective view of an antenna module according to a first preferred embodiment of the present invention.

FIG. 4 is a perspective view of an antenna module showing a first preferred embodiment of the present invention. A ground element 14 designed to become a ground potential is formed from a rectangular planar conductor (e.g., copper foil). Similarly, an antenna element 16 is formed from a planar conductor. The antenna element 16 is arranged so as to be opposed to the ground element 14. The ground element 14 and the antenna element 16 are substantially parallel to each other.

A loop element 18 is formed from a rectangular tubular conductor. The loop element 18 is provided between the ground element 14 and the antenna element 16 in predetermined positional relationship to these elements. The loop element 18 is electrically connected with the antenna element 16. In this preferred embodiment, the antenna element 16 and the loop element 18 are formed by bending a rectangular conductor foil along lines perpendicular to its longitudinal direction.

An element support 20 supporting the ground element 14, the antenna element 16 and the loop element 18 is formed, for example, by partially filling the space between the ground element 14 and the antenna element 16 with an insulating, curing fluid in such a manner as to substantially fully cover the outer surface of the loop element 18 with the fluid, and then curing the fluid. A hollow portion 21 is defined inside the loop element 18 so as to pass across the width of the antenna module. The element support 20 is formed with a hollow portion 22 defined around the loop element 18 in an L-shaped configuration so as to pass across the width of the antenna module, i.e., pass in the same direction as that of the hollow portion 21 of the loop element 18.

According to this preferred embodiment, all the elements 14, 16 and 18 are supported by the element support 20 formed of an insulator (dielectric), so that the antenna module can be reduced in size. Furthermore, since the hollow portion 22 is defined in the element support 20, the antenna module can be reduced in weight. Furthermore, the hollow portion 22 of the element support 20 passes through the antenna module in the same direction as that of pass of the hollow portion 21 of the loop element 18 through the antenna module, so that the antenna module can be easily manufactured by the use of a mold.

In the antenna module shown in FIG. 4, a primary factor deciding the electrical characteristics of the module consists of the shapes of the elements 14, 16 and 18, the distances between the antenna element 16 and the ground element 14 and between the loop element 18 and the ground element 14, and the shape of the hollow portion 22 of the element support 20. In particular, the resonance frequency of the antenna module largely depends on the distance between the loop element 18 and the ground element 14. For example, when this distance changes by 1 mm, the resonance frequency changes by about 50 MHz.

In this preferred embodiment, the distance between the loop element 18 and the ground element 14 can be stabilized at a uniform value because the direction of pass of the hollow portion 22 of the element support 20 is identical with the direction of pass of the hollow portion 21 of the loop element 18. Accordingly, the electrical characteristics to be required can be easily obtained.

Figure 5:
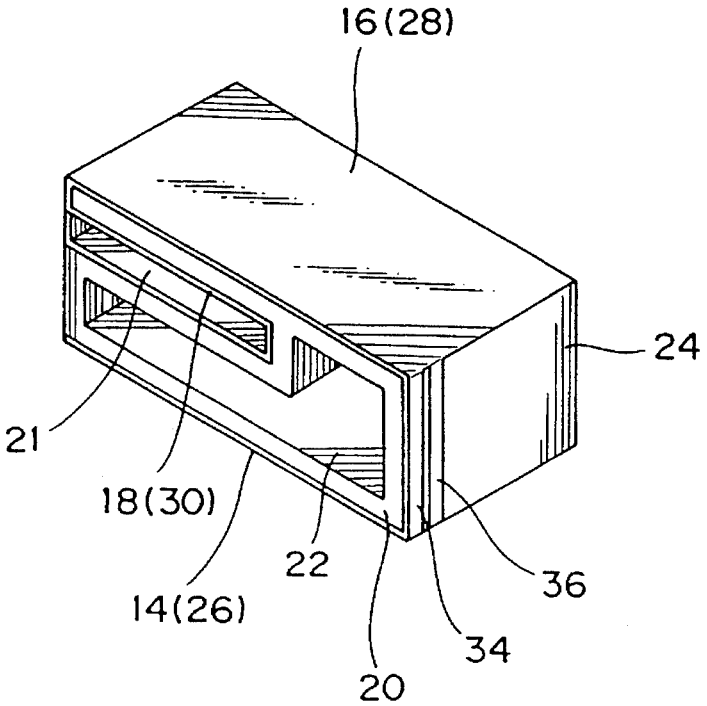
FIG. 5 is a perspective view of an antenna module according to a second preferred embodiment of the present invention.

FIG. 5 is a perspective view of an antenna module showing a second preferred embodiment of the present invention. The second preferred embodiment is different from the first preferred embodiment in the point that a flexible printed wiring board is used and that all the elements 14, 16 and 18 are formed from conductor patterns of the flexible printed wiring board. The flexible printed wiring board has a resin film 24 and the above-mentioned conductor patterns including the ground element 14, the antenna element 16 and the loop element 18. The resin film 24 is formed of polyimide resin, for example. The resin film 24 has a first surface closely attached to the element support 20 and a second surface on which the conductor patterns are formed.

Figure 6:
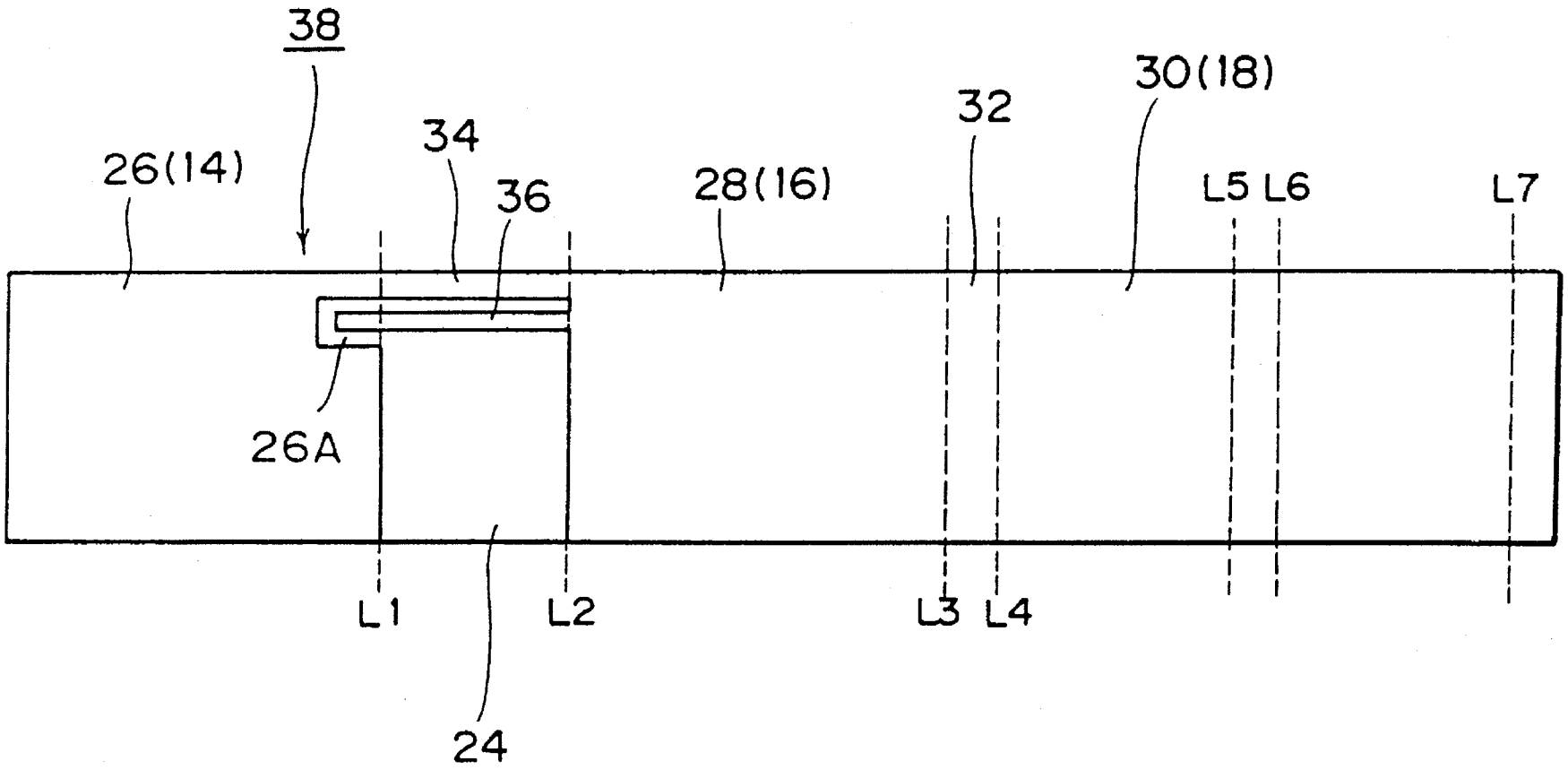
FIG. 6 is a development of a flexible printed wiring board constituting the antenna module shown in FIG. 5.

FIG. 6 is a development of the flexible printed wiring board as viewed from the conductor pattern side. Reference numeral 38 generally designates the flexible printed wiring board. The resin film 24 has an elongated, rectangular shape. The conductor patterns formed on the resin film 24 include a ground element pattern 26 corresponding to the ground element 14 an antenna element pattern 28 corresponding to the antenna element 16, a loop element pattern 30 corresponding to the loop element 18, and a connection pattern 32 electrically connecting the antenna element pattern 28 with the loop element pattern 30. The ground element pattern 26, the antenna element pattern 28, the connection pattern 32 and the loop element pattern 30! are arranged in this order in the longitudinal direction of the resin film 24.

In this preferred embodiment, a recess or notch 26A is formed at one edge of the ground element pattern 26 on the antenna element pattern 28 side. The conductor patterns formed on the resin film 24 further include a first line pattern 34 having a predetermined width and connecting the ground element pattern 26 with the antenna! element pattern 28, and a second line pattern 36 Raving a predetermined width and extending from the antenna element pattern 28. The second line pattern 36 is substantially parallel to and spaced a predetermined distance from the first line pattern 34. The tip of he second line pattern 36 is located in the recess 26A Of the ground element pattern 26. The first and second line patterns 34 and 36 function as a ground line and a signal line at high frequencies, respectively. The shapes of the line patterns 34 and 36 may be set according to the required characteristics such as impedance characteristics.

In FIG. 6, broken lines L1 to L7 arranged in series from the ground element pattern 26 side represent bending lines in bending the flexible printed wiring board 38. More specifically, the flexible printed wiring board 38 is bent at substantially right angles along the bending lines L1 to L4 so that the conductor patterns become outside, and is bent at substantially right angles along the bending lines L5 to L7 so that the conductor patterns become inside. The formation of the conductor patterns as shown in FIG. 6 may be performed by any usual method such as etching.

Figure 7:
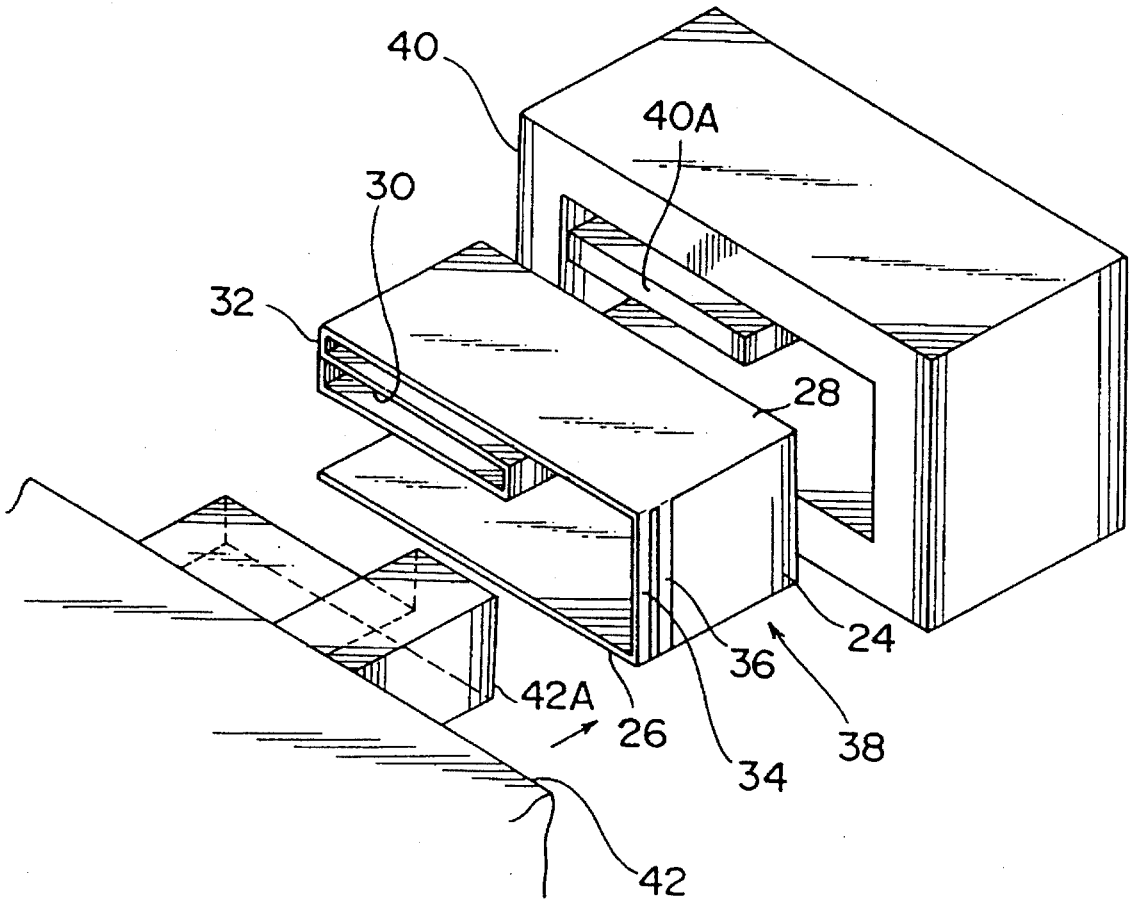
FIG. 7 is a schematic perspective view illustrating a manufacturing method for the antenna module of the second preferred embodiment shown in FIG. 5.

FIG. 7 shows a preferred embodiment of a manufacturing method for the antenna module shown in FIG. 5. Firstly, the flexible printed wiring board 38 shown in FIG. 6 is bent along the bending lines L5 to L7 to form the loop element 18 from the loop element pattern 30. At this time, the free end of the loop element pattern 30 may be soldered to the connection pattern 32.

Secondly, the flexible printed wiring board 38 is bent along the bending lines L1 to L4, and is then set in a mold. The mold is composed of a first mold 40 having a projection 40A corresponding to the first hollow portion 21 of the loop element 18 (see FIG. 5) and a second mold 42 having a projection 42A corresponding to the second hollow portion 22 of the element support 20 (see FIG. 5).

Finally, a curing fluid is injected from an injection hole (not shown) of the first mold 40 or the second mold 42 into a cavity defined by the first and second molds 40 and 42, thereby bringing the curing fluid into contact with the resin film 42 of the flexible printed wiring board 38. As the curing fluid, thermosetting resin such as epoxy resin may be used, or thermoplastic resin may be used instead, of course. After the curing fluid is cured, the first and second molds 40 and 42 are separated from each other to thereby obtain the antenna module shown in FIG. 5.

According to the method shown in FIG. 7, there is no possibility of generation of wrinkles or cracks in the conductor patterns of the flexible printed wiring board 38 in injecting the curing fluid because the conductor patterns to become the elements 14, 16 and 18 shown in FIG. 5 are formed on the resin film 24. Accordingly, the yield of the antenna module can be improved. The reason why the curing fluid is brought into contact with the resin film 24 of the flexible printed wiring board 38 in the method shown in FIG. 7 is that when the curing fluid is cured to become the element support 20 (see FIG. 5), a high bonding strength between the element support 20 and the resin film 24 can be easily obtained. However, prior to injecting the curing fluid, adhesive may be preliminarily applied to the resin film 24 as required.

According to the construction of the antenna module shown in FIG. 5, the tip of the line pattern 36 functioning as a signal line is located on the same plane as that of the ground element 14 in insulated relationship thereto as well shown in FIG. 6. Accordingly, the form of the antenna module can be made fit for surface mounting.

While the conductor patterns of the flexible printed wiring board 38 shown in FIG. 6 include all of the ground element 14, the antenna element 16 and the loop element 18, the conductor patterns may include only one or two of these elements. In this case, the other elements or element are/is formed from a copper foil.

In this preferred embodiment, the flexible printed wiring board 38 includes all of the above elements. Accordingly, in manufacturing the antenna module by the method shown in FIG. 7, it is sufficient to only set the single flexible printed wiring board 38 in the mold, thus greatly improving the workability.

Figure 8:
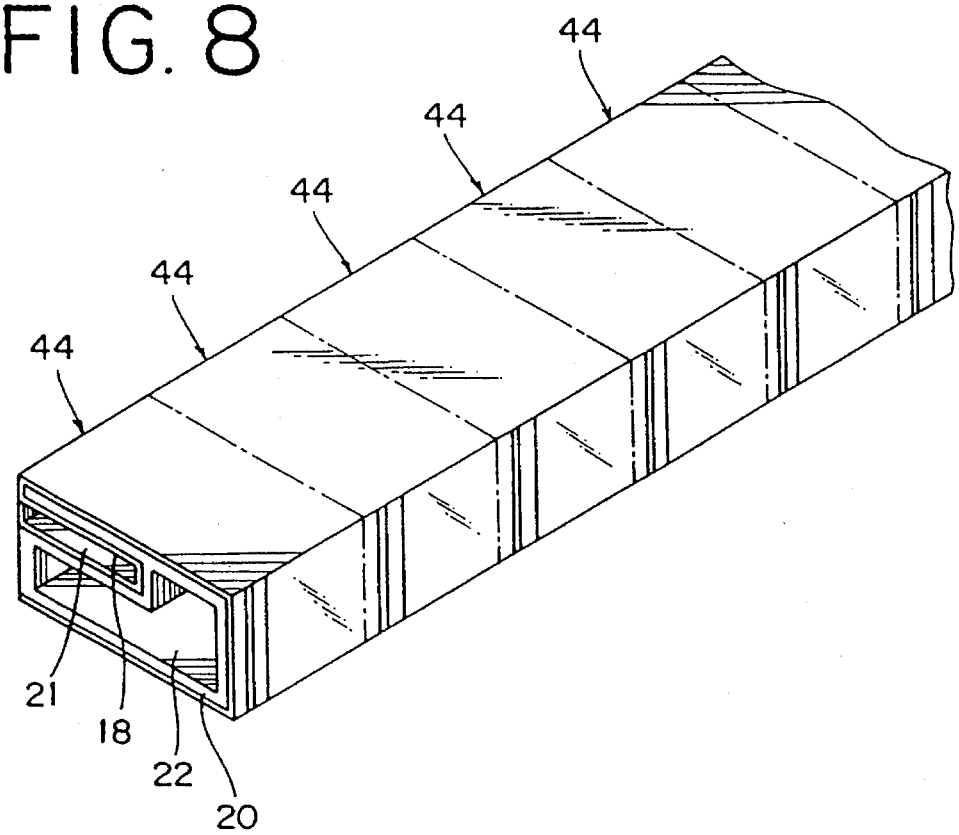
FIG. 8 is a schematic perspective view illustrating a manufacturing method suitable for mass production of the antenna module of the second preferred embodiment shown in FIG. 5.

FIG. 8 illustrates a manufacturing method suitable for the mass production of the antenna module shown in FIG. 5. In the present invention, the direction of pass of the hollow portion 22 of the element support 20 is identical with the direction of pass of the hollow portion 21 of the loop element 18 (see FIG. 4 or FIG. 5). Accordingly, a plurality of antenna modules 44 each having the construction of the antenna module shown in FIG. 5 can be obtained by a single molding process using the method shown in FIG. 7. That is, a base material for the antenna modules 44 is first prepared by using the molds 40 and 42 respectively having the elongated projections 40A and 42A, and the base material thus prepared is then cut along the parallel planes shown by dash-dot lines in FIG. 8. Each cut plane is perpendicular to the direction of pass of the hollow portion 21 of the loop element 18 and the hollow portion 22 of the element support 20.

Figure 9:
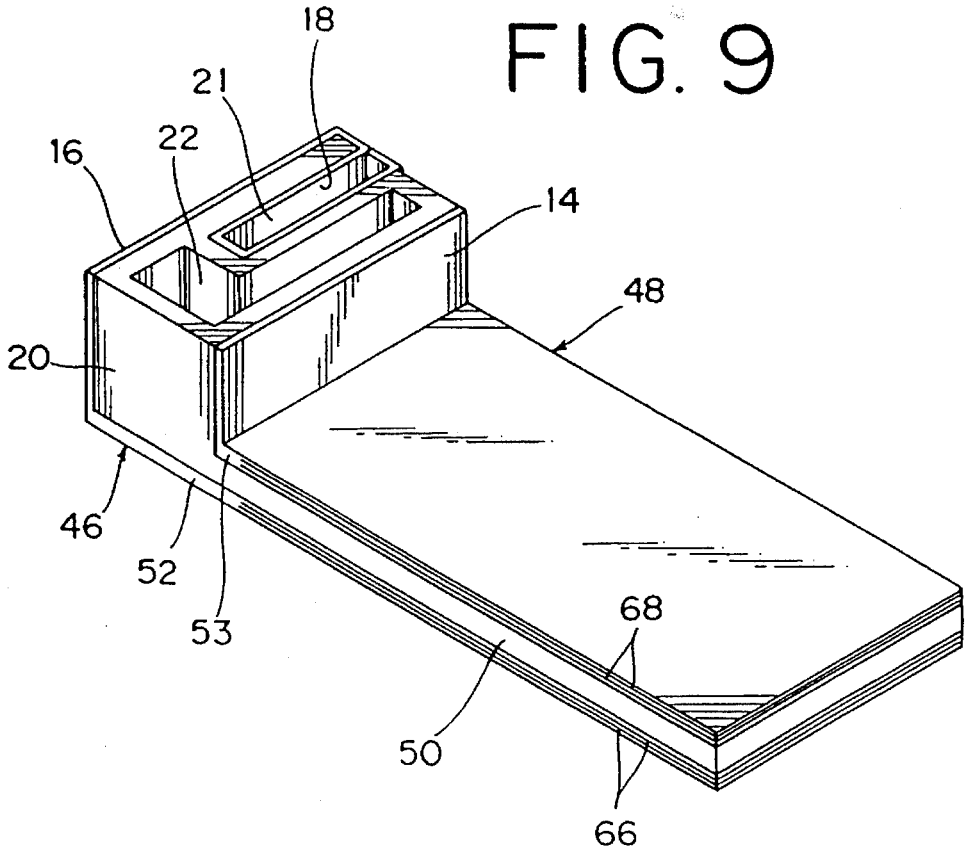
FIG. 9 is a perspective view of an antenna module according to a third preferred embodiment of the present invention.

FIG. 9 is a perspective view of an antenna module showing a third preferred embodiment of the present invention. In this preferred embodiment, the antenna element 16 and the loop element 18 are included in conductor patterns of a lower flexible printed wiring board 46. The lower flexible printed wiring board 46 has a portion on which circuit parts are to be mounted. The ground element 14 is included in conductor patterns of an upper flexible printed wiring board 48. The upper flexible printed wiring board 48 also has a portion on which circuit parts are to be mounted.

Reference numeral 50 designates a substrate formed of an insulator, which is integrally formed with the element support 20. The substrate 50 is sandwiched between the circuit parts mounting portions of the flexible printed wiring boards 46 and 48. The lower flexible printed wiring board 46 is composed of a resin film 52 and the above-mentioned conductor patterns including the antenna element 16 and the loop element 18. The resin film 52 has a first surface closely attached to both the element support 20 and the substrate 50 and a second surface on which the conductor patterns are formed. The conductor patterns of the lower flexible printed wiring board 46 include the antenna element 16, the loop element 18, and a circuit pattern for surface-mounting the circuit parts.

The upper flexible printed wiring board 48 is composed of a resin film 53 and the above-mentioned conductor patterns including the ground element 14. The resin film 53 has a first surface closely attached to both the element support 20 and the substrate 50 and a second surface on which the conductor patterns are formed. The conductor patterns of the upper flexible printed wiring board 48 include the ground element 14 and a circuit pattern for surface-mounting the circuit parts.

Figure 10:
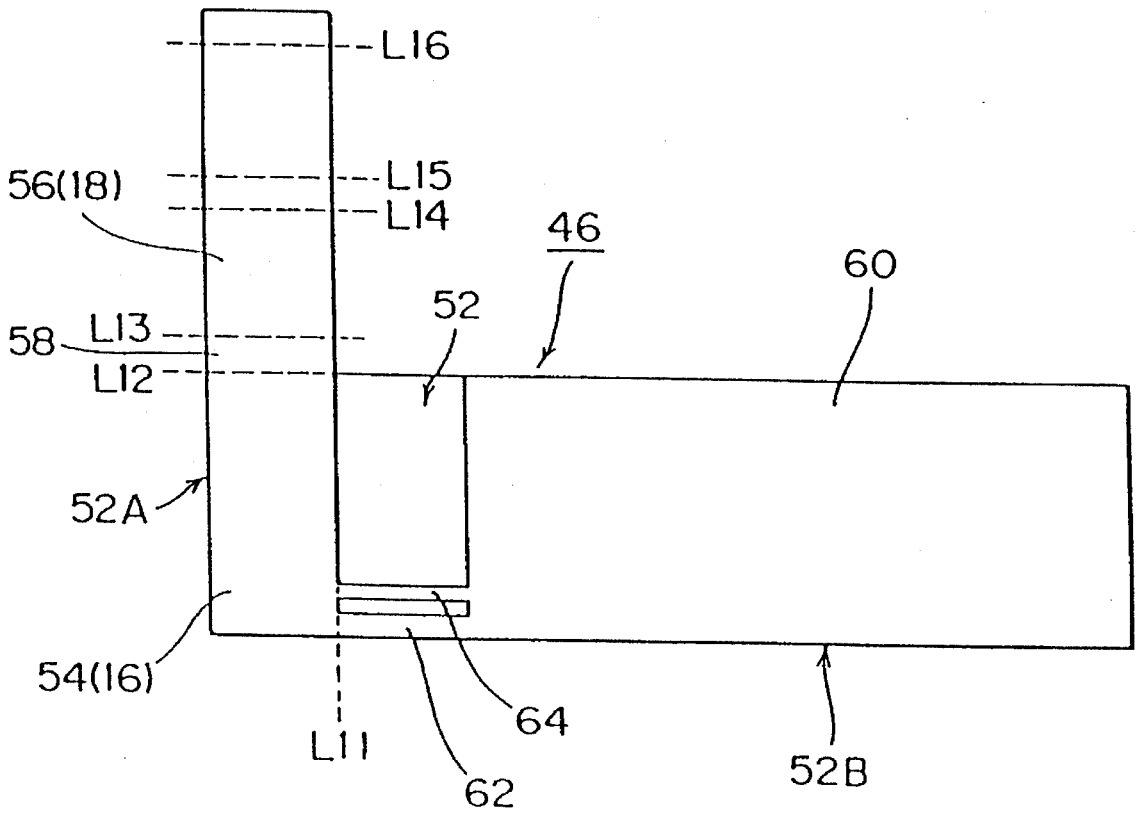
FIG. 10 is a development of a lower flexible printed wiring board constituting the antenna module shown in FIG. 9.

FIG. 10 is a development of the lower flexible printed wiring board 46 shown in FIG. 9 as viewed from the conductor patterns thereof. The resin film 52 is composed of a first rectangular portion 52A and a second rectangular portion 52B integrally formed with the first rectangular portion 52A in such a manner as to extend from a longitudinal part of the first rectangular portion 52A in a direction perpendicular to the longitudinal direction of the first rectangular portion 52A.

The conductor patterns formed on the resin film 52 include an antenna element pattern 54 corresponding to the antenna element 16, a loop element pattern 56 corresponding to the loop element 18, a connection pattern 58 electrically connecting the antenna element pattern 54 with the loop element pattern 56, a surface-mounting circuit pattern formed on a circuit pattern forming portion 60, and line patterns 62 and 64 both electrically connecting the circuit pattern with the antenna element pattern 54.

The antenna element pattern 54, the connection pattern 58 and the loop element pattern 56 are arranged in this order in the longitudinal direction of the first rectangular portion 52A of the resin film 52. The line patterns 62 and 64 and the circuit pattern forming portion 60 are arranged in this order in the longitudinal direction of the second rectangular portion 52B of the resin film 52 from the antenna element pattern 54 side. Reference numerals L11 to L16 designate bending lines along which the flexible printed wiring board 46 is bent. More specifically, the flexible printed wiring board 46 is bent along the bending lines L11 to L13 so that the conductor patterns become outside, and is bent along the bending lines L14 to L16 so that the conductor patterns become inside.

According to the construction shown in FIG. 9, the substrate 50 and the element support 20 are integrally formed with each other, so that a soldering work for mounting the antenna module shown in FIG. 4 or FIG. 5, for example, onto a printed wiring board is unnecessary. Accordingly, connection failure can be reduced, and equipment incorporating the antenna module can be easily manufactured. In order to increase a wiring density in the circuit parts mounting portions, there may be provided as shown in FIG. 9 a laminated circuit pattern 66 to be laminated on the surface-mounting circuit pattern of the lower flexible printed wiring board 46 and/or a laminated circuit pattern 68 to be laminated on the surface-mounting circuit pattern of the upper flexible printed wiring board 48.

In the case where the number of circuit parts to be mounted is small, the circuit parts mounting portion of the upper flexible printed wiring board 48 may be eliminated. Also in the case where the substrate 50 is not integrally formed with the element support 20, the provision of the circuit parts mounting portions in the flexible printed wiring boards 46 and/or 48 is effective in view of omission of wiring to each element of the antenna module.

As described above, the present invention can provide an antenna module and a manufacturing method therefor which can easily obtain required electrical characteristics, can be made fit for a reduction in size and weight of equipment, and can improve the workability.

What is claimed is:

1. An antenna module having two opposing sides and comprising:

a ground element formed of a planar conductor;

an antenna element formed of a planar conductor, said antenna element being arranged substantially parallel to said ground element;

a loop element formed of a tubular conductor, said loop element being arranged between said ground element and antenna element in predetermined positional relationship with both said ground and antenna elements and being electrically connected with said antenna element, said loop element having a first hollow portion extending therethrough in a direction perpendicular to the opposing sides of said antenna module; and an element support formed of an insulator, said element support being arranged so as to fill a space between said ground element and said antenna element and substantially fully cover an outer surface of said loop element, said element support having a second hollow portion extending therethrough in the same direction as that of said first hollow portion of said loop element and in parallel therewith.

2. An antenna module according to claim 1, further comprising a flexible printed wiring board which comprises a resin film and a conductor pattern including at least one of said ground element, said antenna element and said loop element, said resin film having a first surface closely attached to said element support and a second surface on which said conductor pattern is formed.

3. An antenna module according to claim 2, wherein:

said resin film is rectangular;

said conductor pattern comprises a ground element pattern corresponding to said ground element, an antenna element pattern corresponding to said antenna element, a loop element pattern corresponding to said loop element, and a connection pattern connecting said antenna element pattern with said loop element pattern; and said ground element pattern, said antenna element pattern, said connection pattern and said loop element pattern are arranged in this order in a longitudinal direction of said resin film.

4. An antenna module according to claim 3, wherein:

said ground element pattern has a recess in the vicinity of an edge thereof on said antenna element pattern side; and said conductor pattern further comprises a first line pattern having a predetermined width and connecting said ground element pattern with said antenna element pattern, and a second line pattern having a predetermined width and extending from said antenna element pattern, said second line pattern being substantially parallel to and spaced a predetermined distance from said first line pattern, said second line pattern having a tip located in said recess of said ground element pattern.

5. An antenna module according to claim 1, further comprising a first flexible printed wiring board which comprises a first resin film and a first conductor pattern including at least one of said antenna element and said loop element, said first resin film having a first surface closely attached at at least a part thereof to said element support and a second surface on which said first conductor pattern is formed, said first flexible printed wiring board having a portion on which first circuit parts are to be mounted.

6. An antenna module according to claim 5, wherein:

said first resin film comprises a first rectangular portion and a second rectangular portion integrally formed with said first rectangular portion in such a manner as to extend from a longitudinal part of said first rectangular portion in a direction perpendicular to a longitudinal direction of said first rectangular portion;

said first conductor pattern comprises an antenna element pattern corresponding to said antenna element, a loop element pattern corresponding to said loop element, a connection pattern connecting said antenna element pattern with said loop element pattern, a first circuit pattern for connection of said first circuit parts, and at least one line pattern connecting said first circuit pattern with said antenna element pattern;

said antenna element pattern, said connection pattern and said loop element pattern are arranged in this order in a longitudinal direction of said first rectangular portion of said first resin film; and said line pattern and said first circuit pat tern are arranged in this order in a longitudinal direction of said second rectangular portion of said first resin film from said antenna element pattern side.

7. An antenna module according to claim 6, wherein said first resin film has a first laminated circuit pattern laminated therein.

8. An antenna module according to claim 6, further comprising a substrate integrally formed with said element support, said substrate having a first surface to which said first resin film is closely attached and a second surface opposite to said first surface.

9. An antenna module according to claim 8, further comprising a second flexible printed wiring board which Comprises a second resin film and a second conductor pattern including said ground element, said second resin film having a first surface closely attached to said element support and the second surface of said substrate and a second surface on which said second conductor pattern is formed, said second flexible printed wiring board having a portion on which second circuit parts are to be mounted, said second conductor pattern further including a second circuit pattern for connection of said second circuit parts.

10. An antenna module according to claim 9, wherein said second resin film has a second laminated circuit pattern laminated therein.

11. A box-shaped antenna module comprising:

a ground element formed of a planar conductor;

an antenna element formed of a planar conductor, said antenna element being spaced from and arranged in parallel with said ground element;

an element support formed of an insulator and being positioned between said antenna element and said ground element and filling a space between said ground element and said antenna element to define therewith two opposing side walls of the module; and a loop element formed of a tubular conductor positioned between said ground element and said antenna element in predetermined positional relationship with both said ground and antenna elements and being electrically connected with said antenna element, said loop element being enclosed in said element support and having a first hollow portion extending therethrough from one end of the module to an opposite end of the module in a direction perpendicular to said opposing side walls, said element support having a second hollow portion extending therethrough from one end of the module to another end of the module in the same direction as that of said first hollow portion of said loop element.

12. An antenna module according to claim 11, further comprising a flexible printed wiring board including a resin film and a conductor pattern having at least one of said ground element, said antenna element and said loop element, said resin film having a first surface closely attached to said element support and a second surface on which said conductor pattern is formed.

13. An antenna module according to claim 12, wherein:

said resin film is of a rectangular shape;

said conductor pattern includes a ground element pattern corresponding to said ground element, an antenna element pattern corresponding to said antenna element, a loop element pattern corresponding to said loop element, and a connection pattern for connecting said antenna element pattern with said loop element pattern; and said ground element pattern, said antenna element pattern, said connection pattern and said loop element pattern are arranged in this order in a longitudinal direction of said resin film.

14. An antenna module according to claim 13, wherein:

said ground element pattern has a recess in the vicinity of an edge thereof on a side of said antenna element pattern; and said conductor pattern further includes a first line pattern having a predetermined width and connecting said ground element pattern with said antenna element pattern, and a second line pattern having a predetermined width and extending from said antenna element pattern, said second line pattern being substantially parallel to and spaced a predetermined distance from said first line pattern, said second line pattern having a tip located in said recess of said ground element pattern.

15. An antenna module according to claim 11, further comprising a first flexible printed wiring board which comprises a first resin film and a first conductor pattern including at least one of said antenna element and said loop element, said first resin film having a first surface closely attached at least a part thereof to said element support and a second surface on which said first conductor pattern is formed, said first flexible printed wiring board having a portion on which first circuit parts are to be mounted.

16. An antenna module according to claim 15, wherein:

said first resin film comprises a first rectangular portion and a second rectangular portion integrally formed with said first rectangular portion in such a manner as to extend from a longitudinal part of said first rectangular portion in a direction perpendicular to a longitudinal direction of said first rectangular portion;

said first conductor pattern comprises an antenna element pattern corresponding to said antenna element, a loop element pattern corresponding to said loop element, a connection pattern connecting said antenna element pattern with said loop element pattern, a first circuit pattern for connection of said first circuit parts, and at least one line pattern connecting said first circuit pattern with said antenna element pattern;

said antenna element pattern, said connection pattern and said loop element pattern are arranged in this order in a longitudinal direction of said first rectangular portion of said first resin film; and said line pattern and said first circuit pattern are arranged in this order in a longitudinal direction of said second rectangular portion of said first resin film from said antenna element pattern side.

17. An antenna module according to claim 16, wherein said first resin film has a first laminated circuit pattern laminated therein.

18. An antenna module according to claim 16, further comprising a substrate integrally formed with said element support, said substrate having a first surface to which said first resin film is closely attached and a second surface opposite to said first surface.

19. An antenna module according to claim 18, further comprising a second flexible printed wiring board which comprises a second resin film and a second conductor pattern including said ground element, said second resin film having a first surface closely attached to said element support and the second surface of said substrate and a second surface on which said second conductor pattern is formed, said second flexible printed wiring board having a portion on which second circuit parts are to be mounted, said second conductor pattern further including a second circuit pattern for connection of said second circuit parts.

20. An antenna module according to claim 19, wherein said second resin film has a second laminated circuit pattern laminated therein.

21. An antenna module having opposing side walls and comprising:

a ground element formed of a planar conductor;

an antenna element formed of a planar conductor, said antenna element being arranged substantially parallel to said ground element;

a loop element formed of a tubular conductor, said loop element being arranged between said ground element and said antenna element in predetermined positional relationship with both said ground and antenna elements and being electrically connected with said antenna element, said loop element having a first hollow portion extending therethrough in a direction perpendicular to said side walls;

an element support formed of an insulator, said element support being arranged so as to fill a space between said ground element and said antenna element and substantially fully cover an outer surface of said loop element, said element support having a second hollow portion extending therethrough in the same direction as that of said first hollow portion of said loop element;

a flexible printed wiring board including a resin film and a conductor pattern including said ground element, said antenna element and said loop element, and a connection pattern connecting said antenna element with said loop element; said ground element, said antenna element, said connection pattern and said loop element being arranged in this order in a longitudinal direction of said resin film, wherein:

said ground element has a recess in the vicinity of an edge thereof on a side of said antenna element; and said conductor pattern further includes a first line pattern having a predetermined width and connecting said ground element with said antenna element pattern, and a second line pattern having a predetermined width and extending from said antenna element, said second line pattern being substantially parallel to and spaced a predetermined distance from said fist line pattern, said second line pattern having a tip located in said recess of said ground element.

* * * * *